US006990824B1

(12) United States Patent
Jaffer et al.

(10) Patent No.: US 6,990,824 B1
(45) Date of Patent: Jan. 31, 2006

(54) COOLING APPARATUS

(75) Inventors: Sikander Jaffer, Mississauga (CA); Paul Arato, Toronto (CA)

(73) Assignee: QBD Cooling Systems, Inc., (CA)

( * ) Notice: Subject to any disclaimer, the term of this patent is extended or adjusted under 35 U.S.C. 154(b) by 0 days.

(21) Appl. No.: 10/902,637

(22) Filed: Jul. 30, 2004

(51) Int. Cl.
*A47F 3/04* (2006.01)

(52) U.S. Cl. ..... 62/255; 62/426; 454/193

(58) Field of Classification Search ..... 62/255–256, 62/414, 419, 426
See application file for complete search history.

(56) References Cited

U.S. PATENT DOCUMENTS

| | | | | | |
|---|---|---|---|---|---|
| 2,613,507 | A | * | 10/1952 | Pabst | 62/254 |
| 3,324,783 | A | * | 6/1967 | Hickox | 454/193 |
| 3,543,532 | A | * | 12/1970 | Toth et al. | 62/256 |
| 3,561,230 | A | * | 2/1971 | Gatton et al. | 62/256 |
| 4,592,209 | A | * | 6/1986 | Casanova et al. | 62/255 |
| D305,672 | S | | 1/1990 | Corden et al. | |
| D355,995 | S | | 3/1995 | Stoddard et al. | |
| D367,975 | S | | 3/1996 | Robertson et al. | |
| D368,396 | S | | 4/1996 | Bidwell | |
| D395,179 | S | | 6/1998 | Primiano et al. | |
| 5,964,512 | A | * | 10/1999 | Borgen | 312/116 |
| D421,757 | S | | 3/2000 | Volonterio | |
| 6,089,036 | A | * | 7/2000 | Carlson et al. | 62/256 |
| D449,845 | S | | 10/2001 | Reese et al. | |
| D457,354 | S | | 5/2002 | Reese et al. | |
| D460,296 | S | | 7/2002 | Reese et al. | |
| 6,412,296 | B1 | * | 7/2002 | Rossi | 62/255 |

* cited by examiner

*Primary Examiner*—William E. Tapolcai
(74) *Attorney, Agent, or Firm*—Stites & Harbison PLLC; Marvin Petry

(57) ABSTRACT

A cooling apparatus for such things as convenience foods and beverages has a tilted, open faced bed from which persons may select objects. The apparatus is self-contained, and may run from a standard, single phase electrical outlet. It may be carried by two people, and is suitable for mounting either on its own base in a recess in a checkout counter or other similar installation. The open faced be may have a channel depth of section that is relatively deep as compared with to its width, the flow path length, or the depth of the flow released to run along the channel, thereby tending to discourage mixing of the cooled flow with the surrounding ambient environment. The apparatus may include a two piece molded housing that defines the structural skeleton for both the cooling bed and a lodgement for various elements of the cooling system. The bed may include a porous deck, or drain panels, that may tend to encourgare cooled air to drain toward a cooling plenum intake panel. The bed may include a pooling region adjacent to the air intake plenum in which cooler, less buoyant air may collect.

21 Claims, 16 Drawing Sheets

COOLING APPARATUS

FIELD OF THE INVENTION

This invention relates to the field of cooling apparatus for such things as foods and beverages.

BACKGROUND OF THE INVENTION

Commercial coolers for foodstuffs and beverages are well known. However, it may be that it would be desirable to have a cooling apparatus that may be placed next to the cash register in a grocery or convenience store. Further, rather than having a door that may slide or swing open and closed, it may be desirable to have a cooler that, during the hours in which the store is open, may have an open face.

While this may be desirable, it poses a number of technical challenges. First, the space available on the counter near the cash register may be quite constricted. Second, the cooling apparatus may need to be relatively quiet. These desiderata may tend to suggest that it would be helpful to have a unit that is self-contained, and that may be operated from a standard 120 V, 60 Hz single phase electrical outlet (or, in Europe or other places, 220 V, 50 Hz, single phase), and that a relatively low power unit be employed, both to keep the noise level down, and to reduce the heat rejection to the interior of the store. The combined desired features of an open faced cooler with a low power requirement may tend to be a difficult challenge to meet, since open faced coolers, by their nature, may tend to spill cooled air outside the cooler envelope, and may, conversely, tend to gain warm (and frequently humid) air that may spill in from the surrounding environment. Finally, for a unit of this nature, it may be desirable that the unit be relatively portable, such that it may be carried and installed by one, or at most two, persons of average size and strength.

SUMMARY OF THE INVENTION

In an aspect of the invention, there is a cooling apparatus having a plenum. The plenum has an inlet and an outlet. The outlet is located higher than the inlet, and is offset in a lateral direction therefrom. A heat exchanger is mounted in the plenum between the inlet and the outlet. At least one air moving device is mounted in the plenum in series with the heat exchanger. The air moving device is operable to draw air in at the inlet, and to compel air to pass through the heat exchanger and to exit the plenum at the outlet. An open faced bed is mounted between the outlet of the plenum and the inlet of the plenum. The bed has a pooling zone to which relatively cooler air may drain. The inlet of the plenum is mounted to draw from the pooling zone. The bed has an air drain manifold mounted therein. The drain manifold is located in the bed in a position to facilitate movement of air to the pooling zone.

In a feature of that aspect of the invention, the cooling apparatus is a self-contained cooling apparatus further including a housing, the open bed being defined within the housing. The housing has an upper portion and a lower portion, and at least one intermediate mounting fitting. The upper portion stands upwardly of the mounting fitting, and the lower portion extends downwardly of the mounting fitting. In another feature, the mounting fitting is a peripheral mounting array. In still another feature, the peripheral mounting array includes at least one shoulder. In an alternate feature, the upper portion has a first peripheral footprint, the lower portion has a second peripheral footprint, at least a portion of the first peripheral footprint extending proud of the first peripheral footprint, and the mounting fitting including at least one shoulder between the upper and lower portions of the housing. In another feature, the cooling apparatus is a self-contained cooling apparatus further including a housing, the open bed being defined within the housing, and the plenum being contained within the housing. A vapour cycle cooling system is mounted within the housing, the heat exchanger being an evaporator of the vapour cycle cooling system; and the cooling apparatus is contained in a volumetric envelope of less than 15,000 cubic inches.

In another feature, the cooling apparatus is a self-contained cooling apparatus having an upper portion, a lower portion, and a mounting fitting, the mounting fitting being placed between the upper portion and the lower portion, the upper portion having a first height, the lower portion having a second height, and a ratio of the first height to the second height being in the range of 1:5 to 1:3. In another feature of that aspect of the invention, the apparatus has a width and the plenum extends across at least half of the width. In still another feature, the plenum extends across more than 80% of the width. In yet another feature, a portion of the plenum downstream of the heat exchanger has a width, W, and a depth, D, and an aspect ratio of the width to the depth of greater than 8:1. In a more narrow range the aspect ratio is greater than 12:1. In still yet another feature, the plenum has a narrowed region downstream of the heat exchanger, and a wider, deceleration region downstream of the narrowed region adjacent the outlet.

In another feature of that aspect of the invention, the cooling apparatus includes a resistance array mounted athwart the outlet. In still another feature, the bed has a base wall, and the base wall of the bed also forms a wall of the plenum downstream of the heat exchanger.

In another feature, the open bed has raised sidewalls extending between the outlet of the plenum and the inlet of the plenum. In a further feature, the bed included an inclined base wall. In a still further feature, the cooling apparatus has a removable cover for enclosing the open bed.

In another feature of that aspect of the invention, the cooling apparatus has a molded plastic housing, the housing bounding the bed, and defining a lodgement for a vapour cycle cooling system, the heat exchanger being an evaporator of the vapour cycle cooling system, the moulded plastic housing including an insulated wall between the lodgement and the plenum. In still a further feature, the cooling apparatus has a weight of less than 80 lbs., and falling within an envelope less than 30 inches wide, 30 inches high, and 36 inches deep. In still another feature, the apparatus causes a cooling flow to pass through the bed, and the cooling flow has a nominal Reynolds number in the range of 2500 to 10,000. In yet another feature, the plenum and the bed are separated by a bed plate, the bed plate forming a wall of the plenum, and, in operation, downstream of the heat exchanger, the bed plate flow interacting with the bed plate within the plenum has a nominal Nusselt number in the range of 10 to 25.

These and other aspects and features of the invention may be understood with reference to the detailed descriptions of the invention and the accompanying illustrations as set forth below.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which.

DETAILED DESCRIPTION OF THE INVENTION

Figure 1:
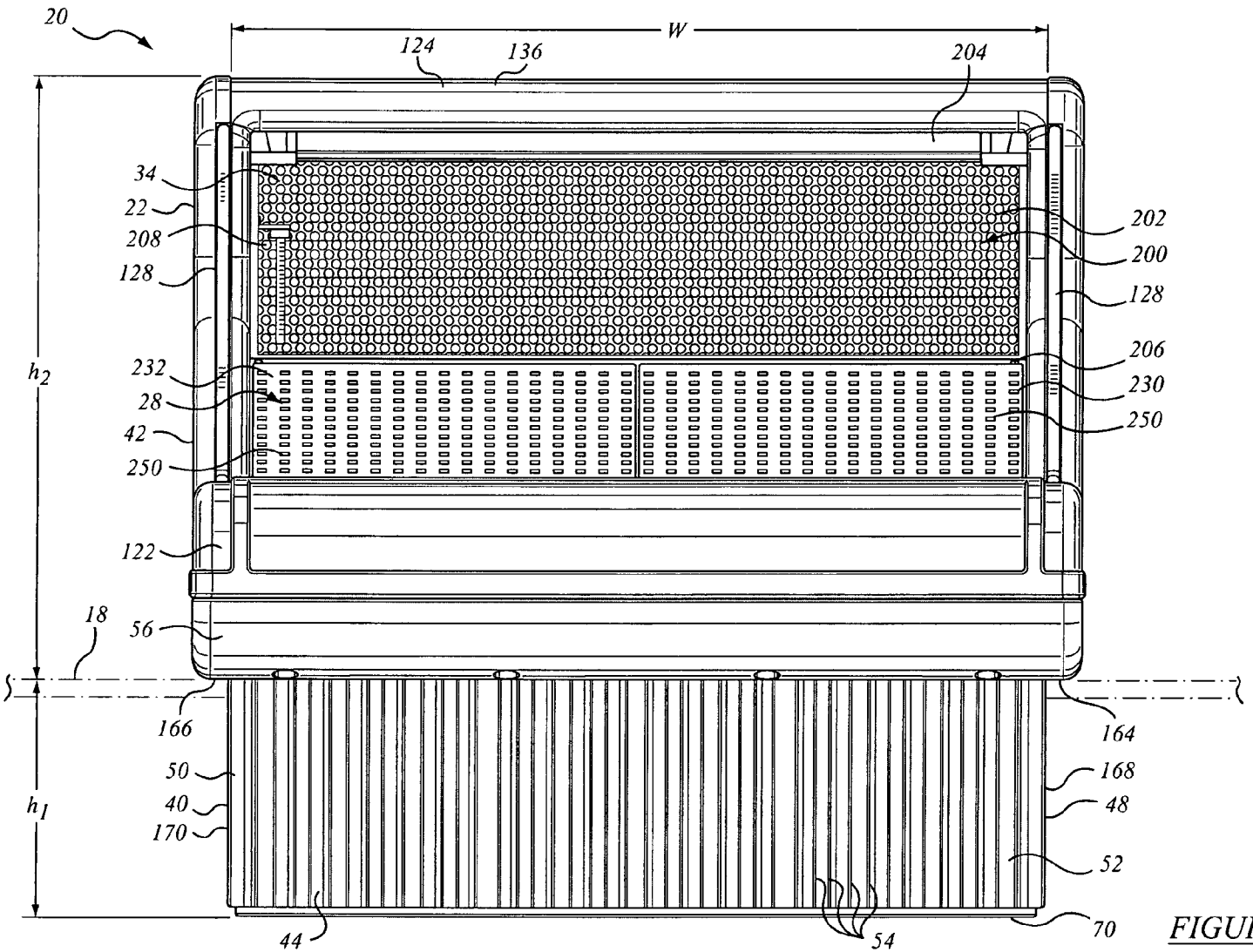
FIG. 1 shows a front view of an example of cooling apparatus embodying an aspects of the present invention.
Figure 2:
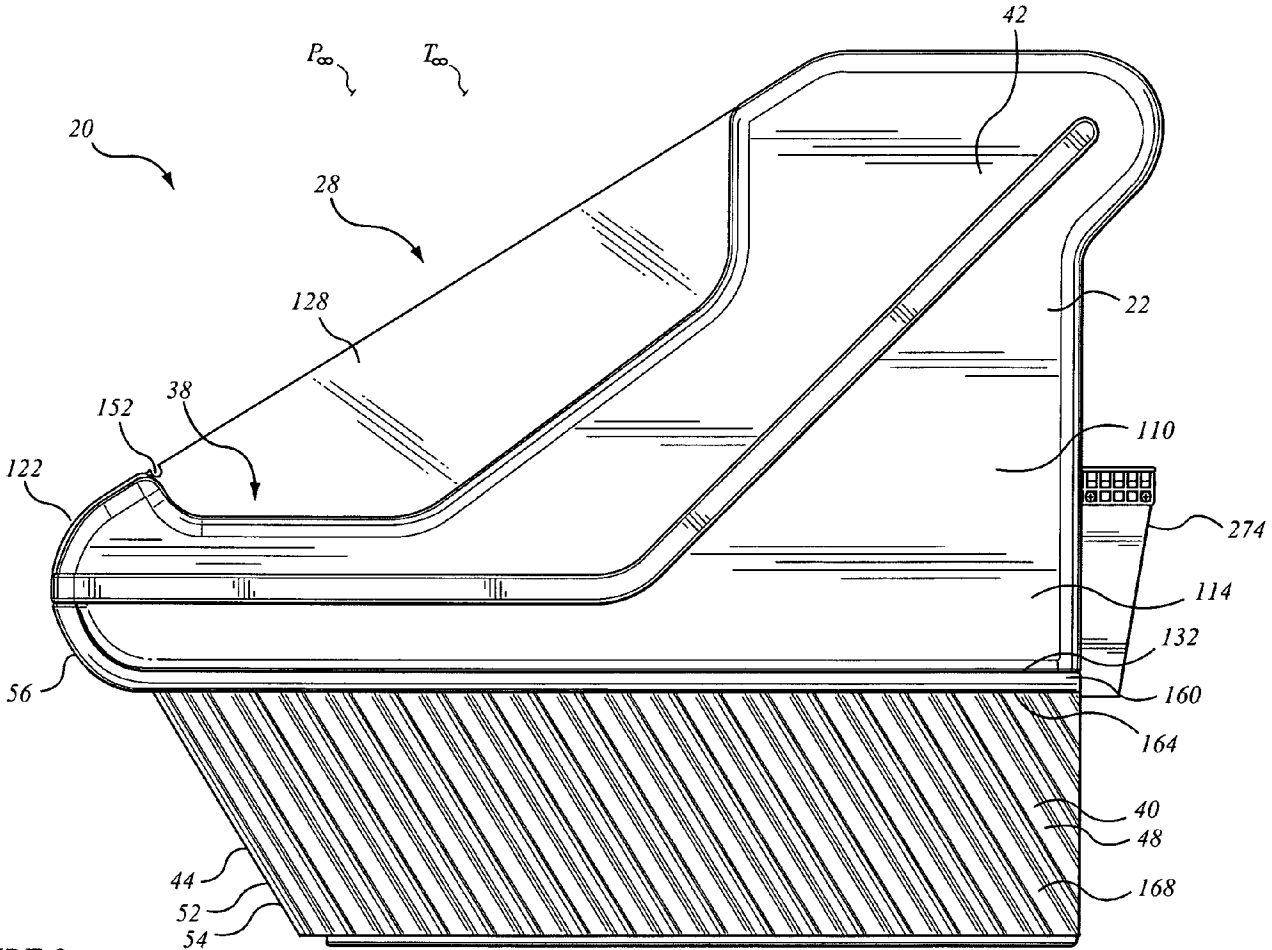
FIG. 2 shows a left hand side view of the cooling apparatus of FIG. 1.
Figure 3:
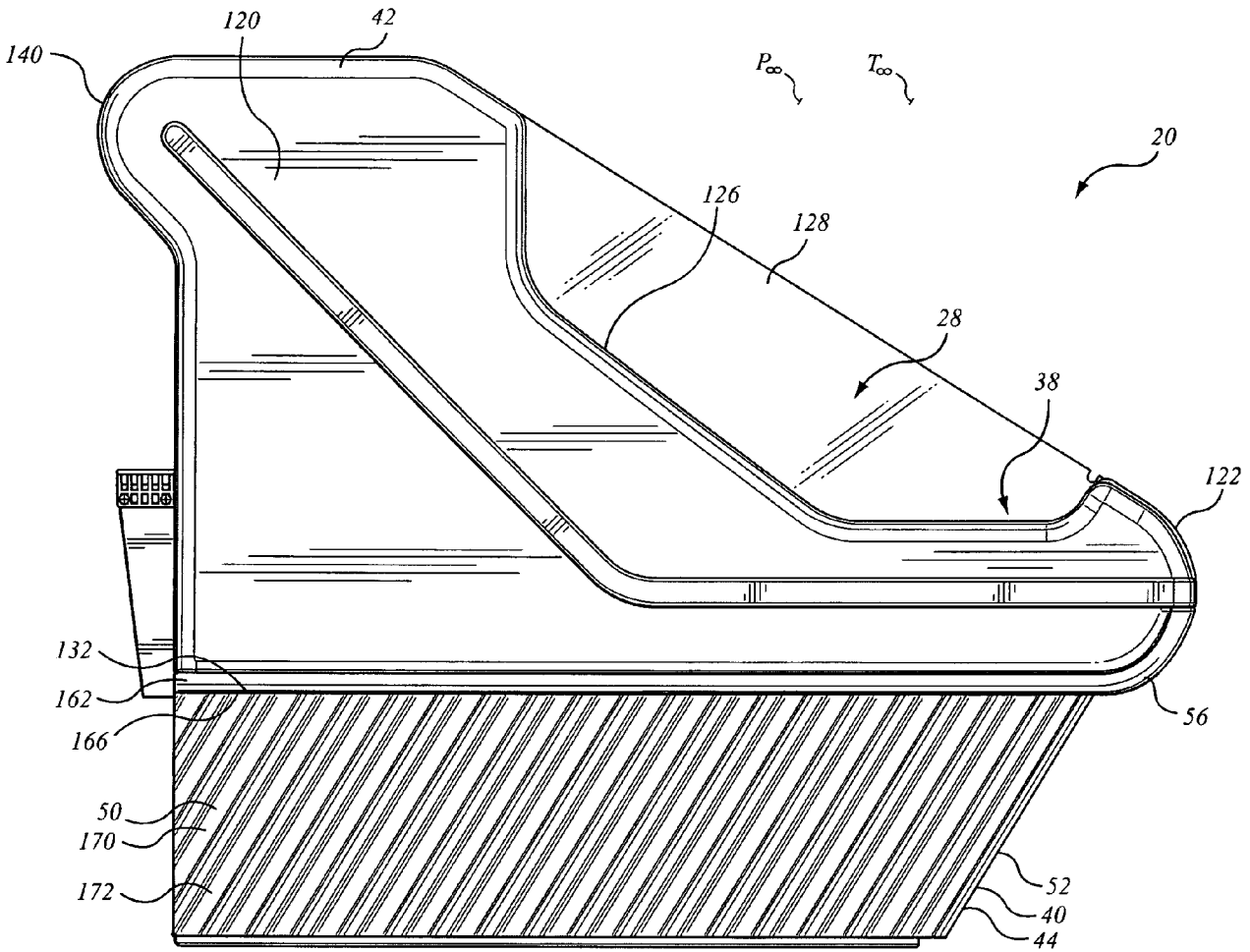
FIG. 3 shows a right hand side view of the cooling apparatus of FIG. 1.
Figure 4:
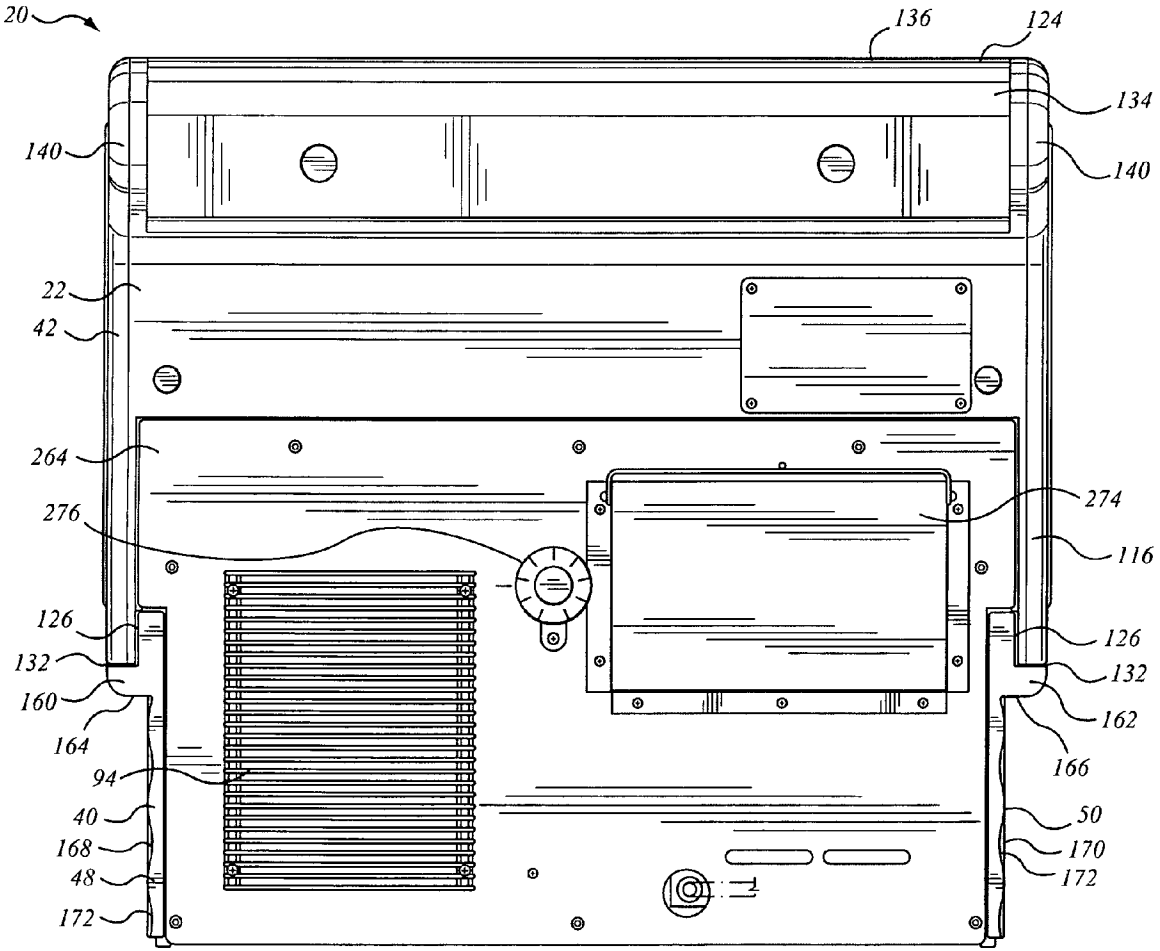
FIG. 4 shows a rear view of the cooling apparatus of FIG. 1.
Figure 5:
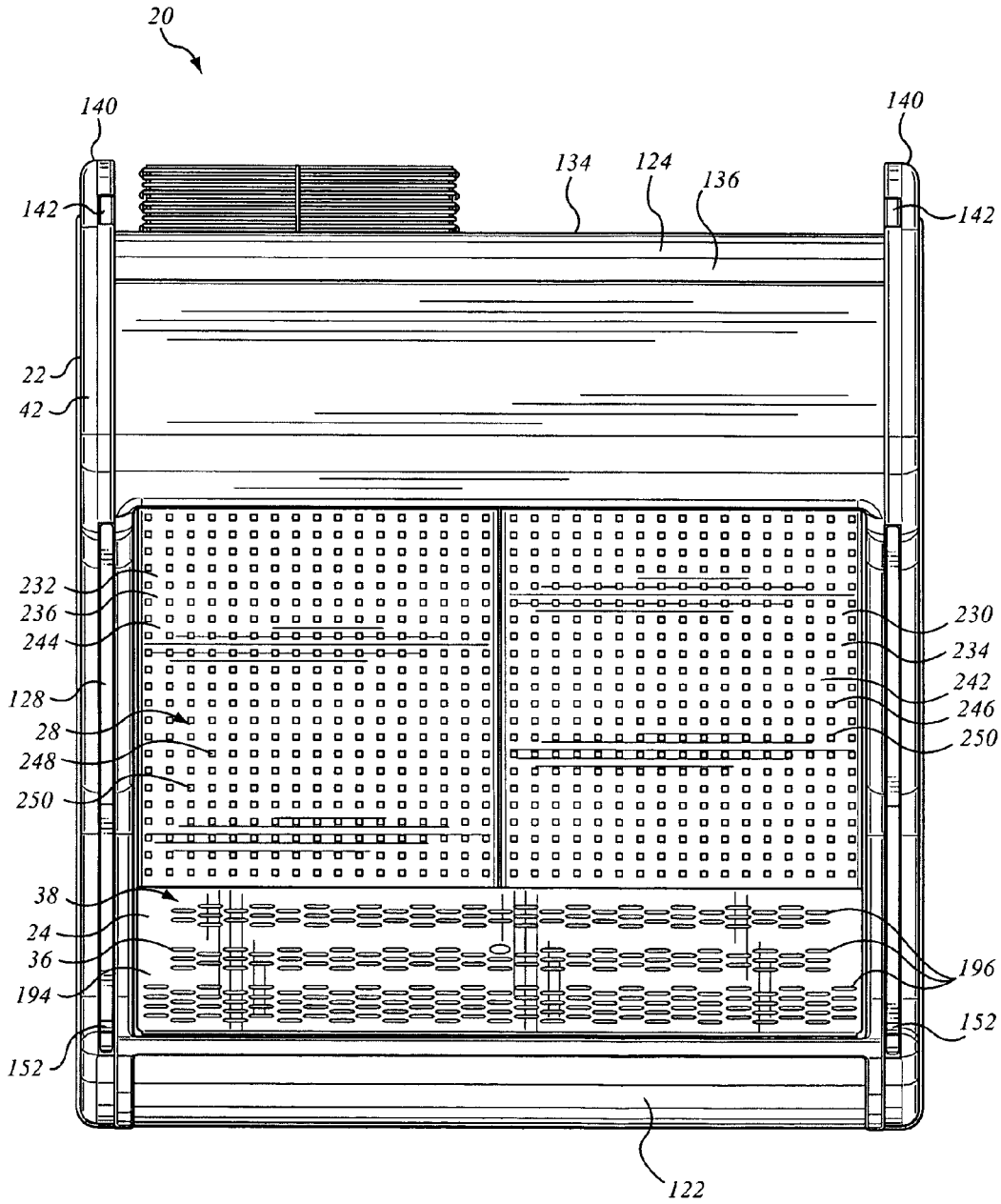
FIG. 5 shows a top view of the cooling apparatus of FIG. 1.
Figure 6:
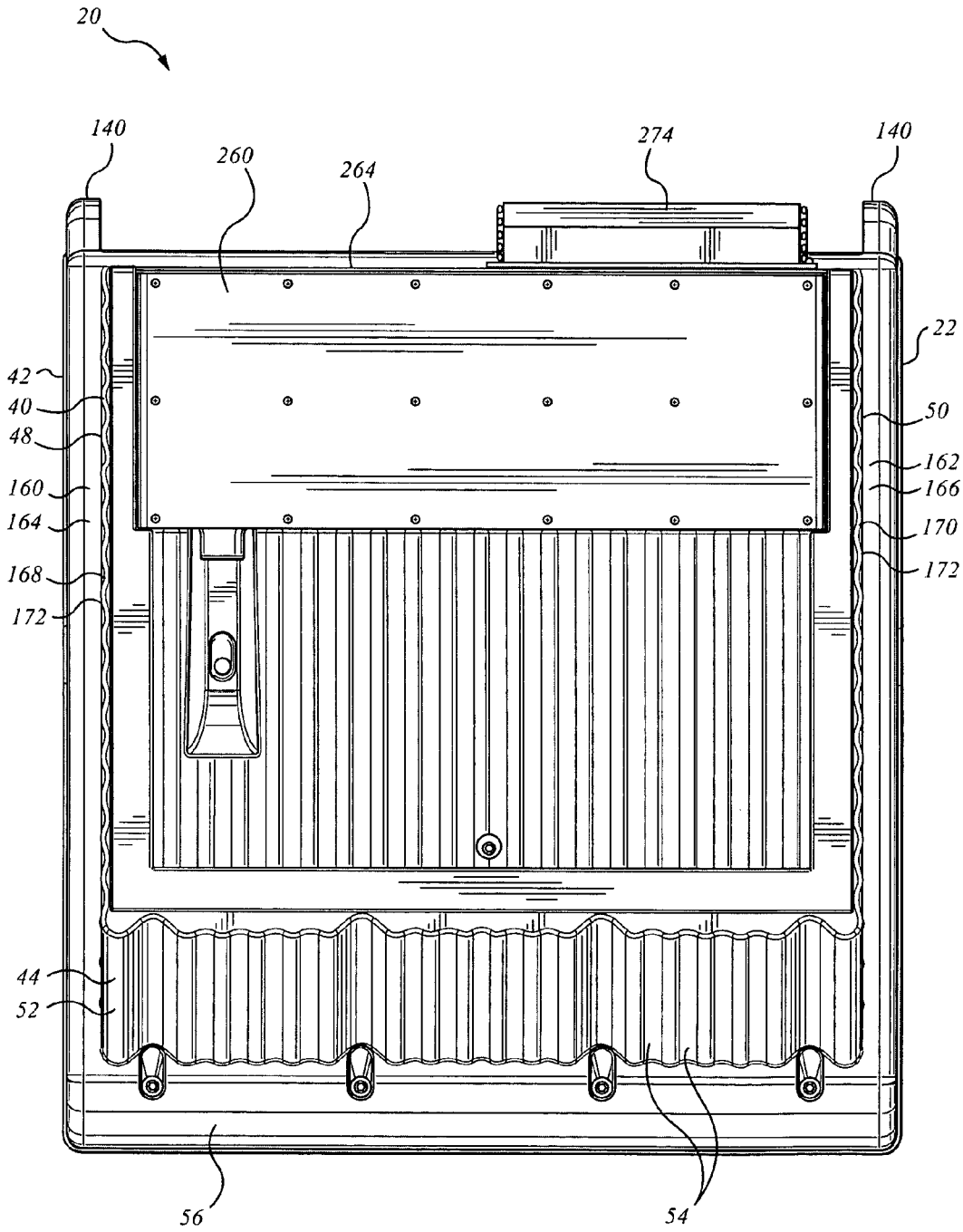
FIG. 6 shows a bottom view of the cooling apparatus of FIG. 1.
Figure 7:
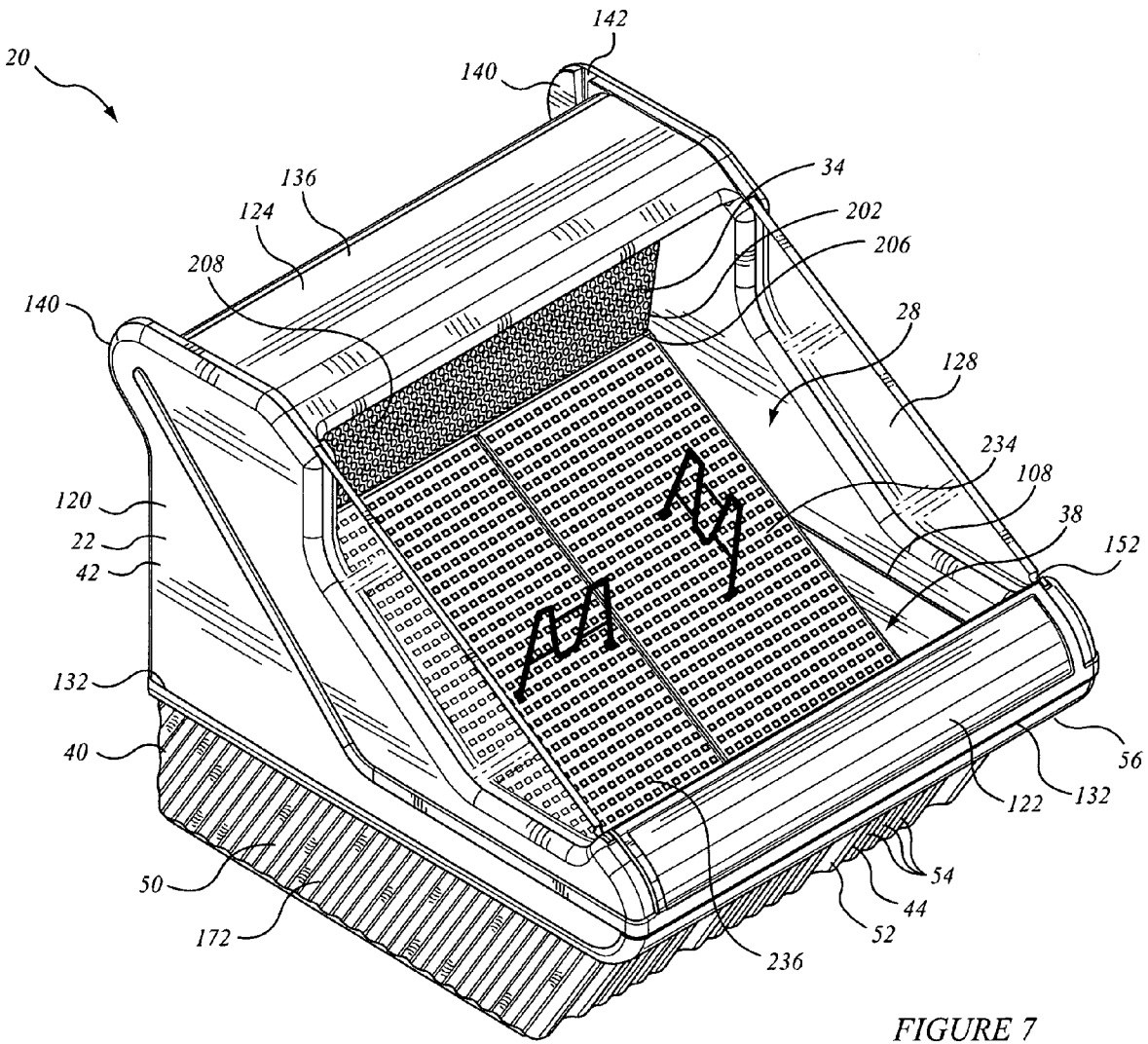
FIG. 7 shows a perspective view from above, in front, and to the right of the apparatus of FIG. 1.
Figure 8:
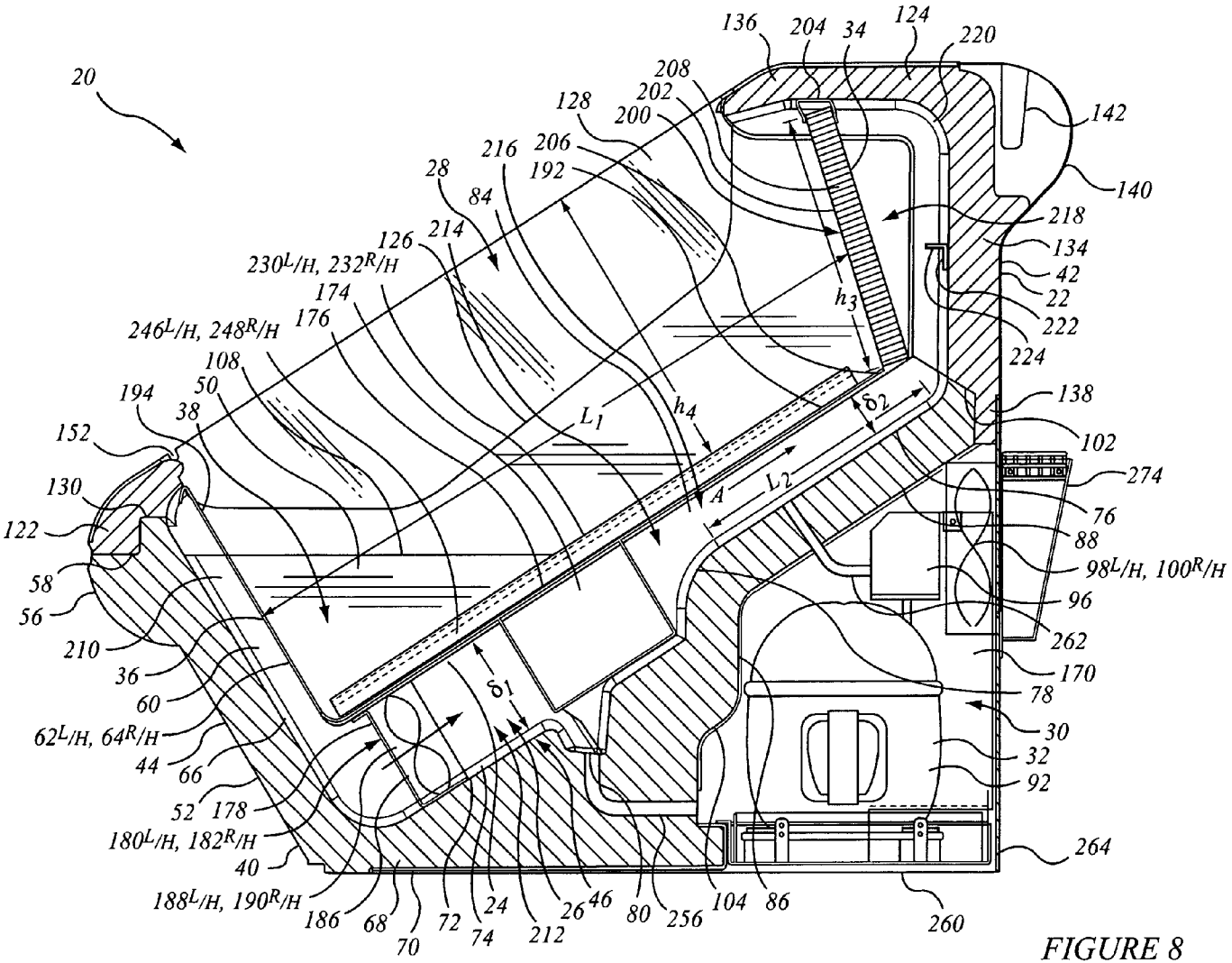
FIG. 8 shows a cross-sectional view of the cooling apparatus of FIG. 1 taken on the central plane of the apparatus.
Figure 9:
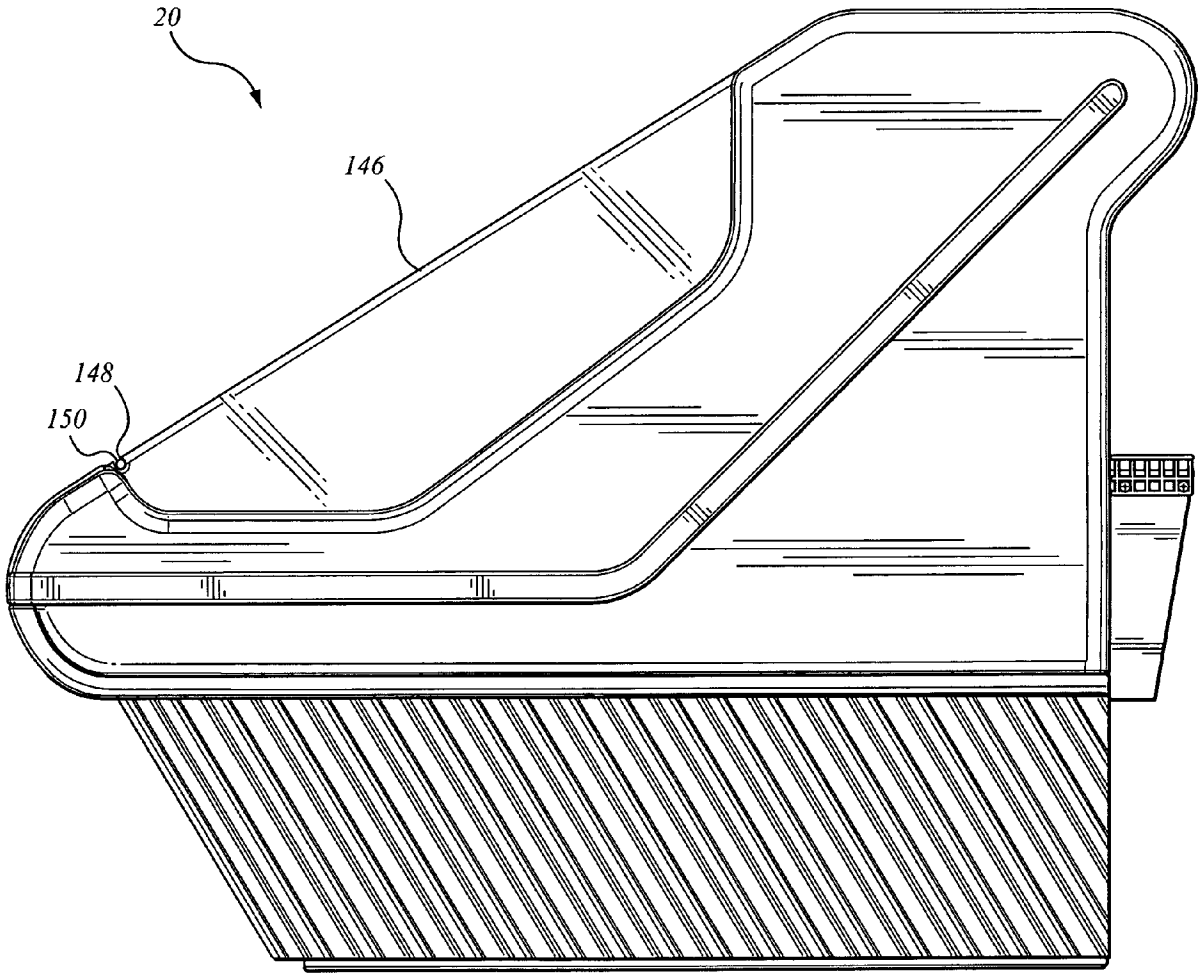
FIG. 9 is a side view of the apparatus of FIG. 1 with a cover in place.
Figure 10:
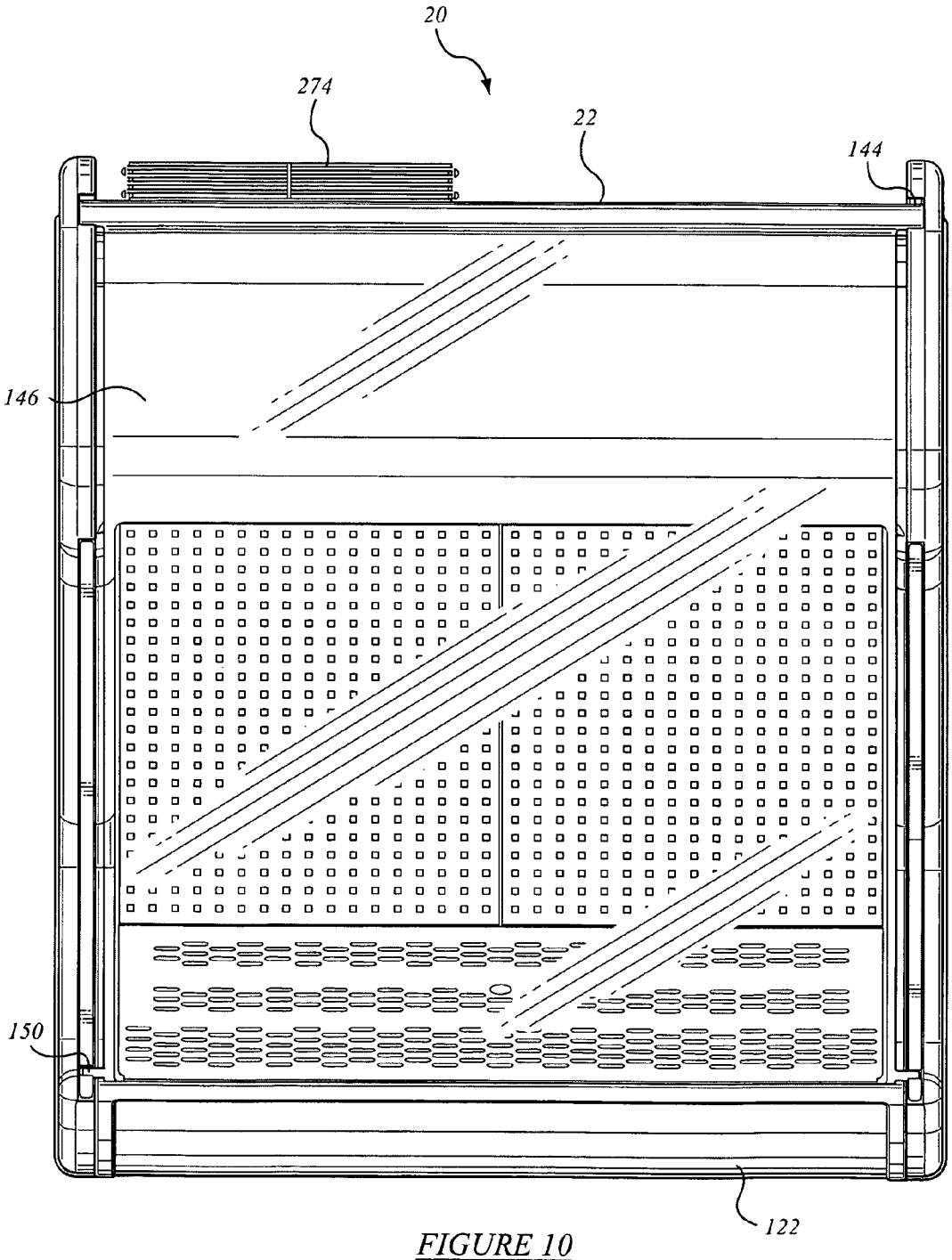
FIG. 10 is a top view of the apparatus of FIG. 1 with a cover in place.
Figure 11:
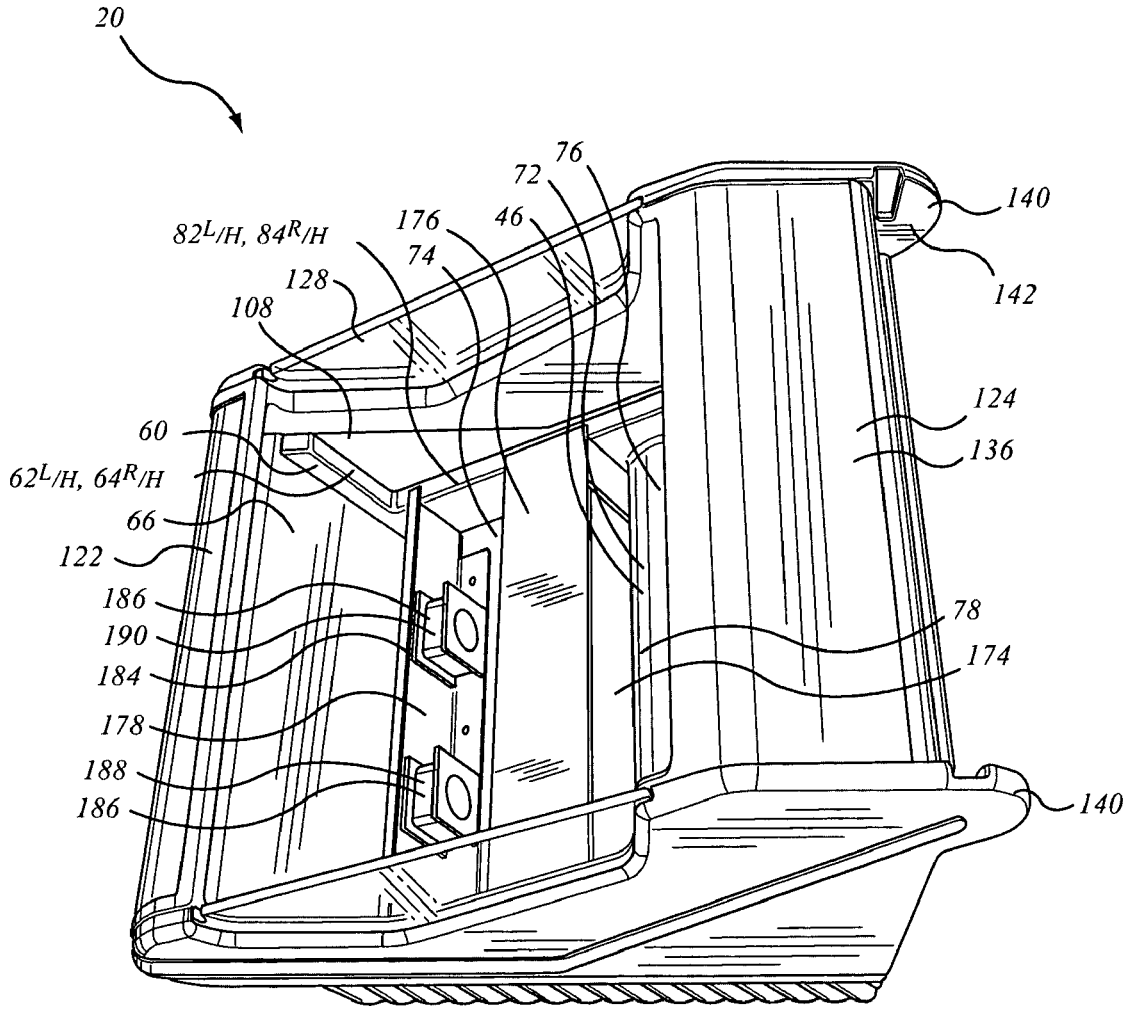
FIG. 11 shows the apparatus of FIG. 1 from above and to one side with internal panels removed.
Figure 12:
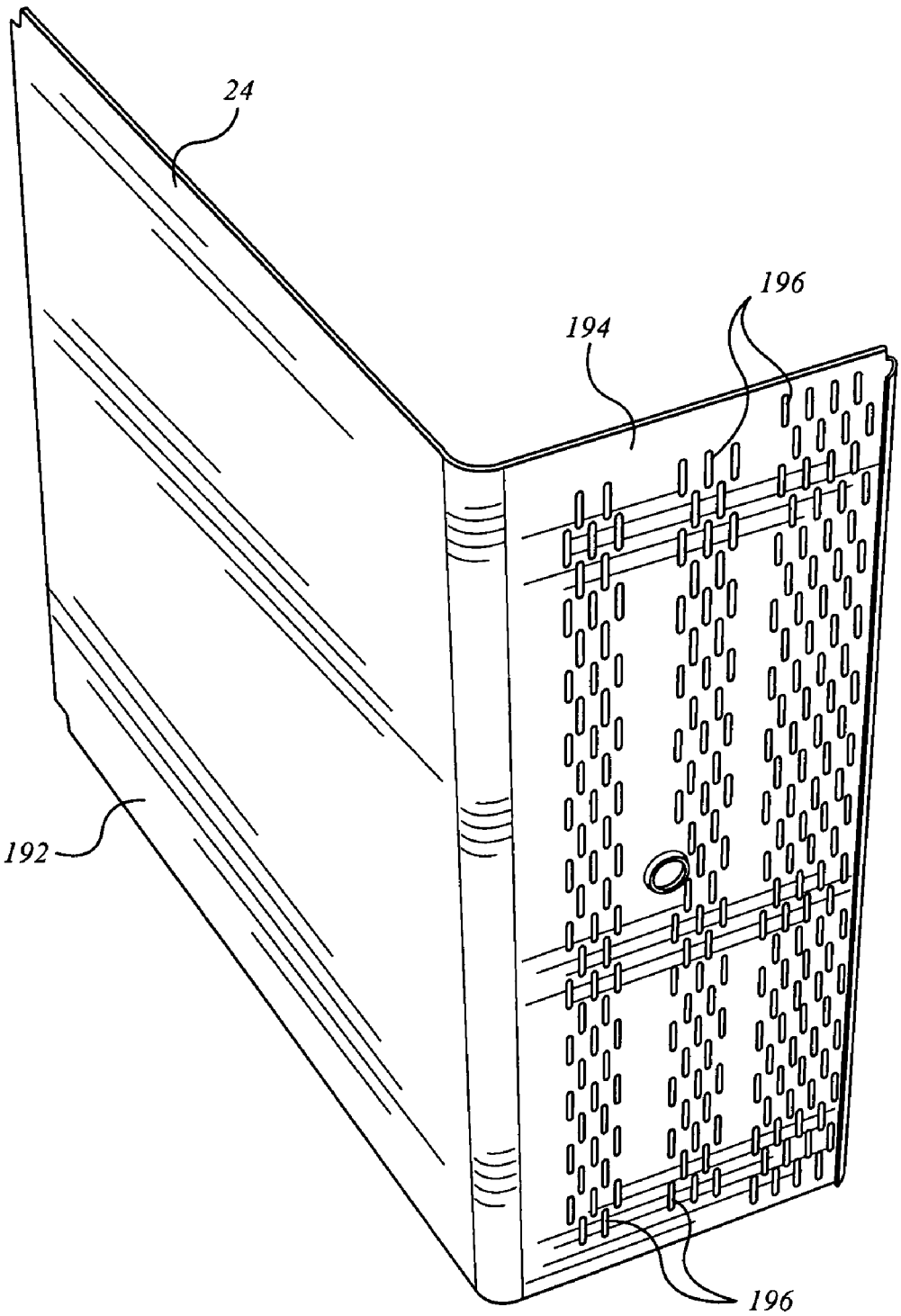
FIG. 12 shows a bed panel of the apparatus of FIG. 1.
Figure 13:
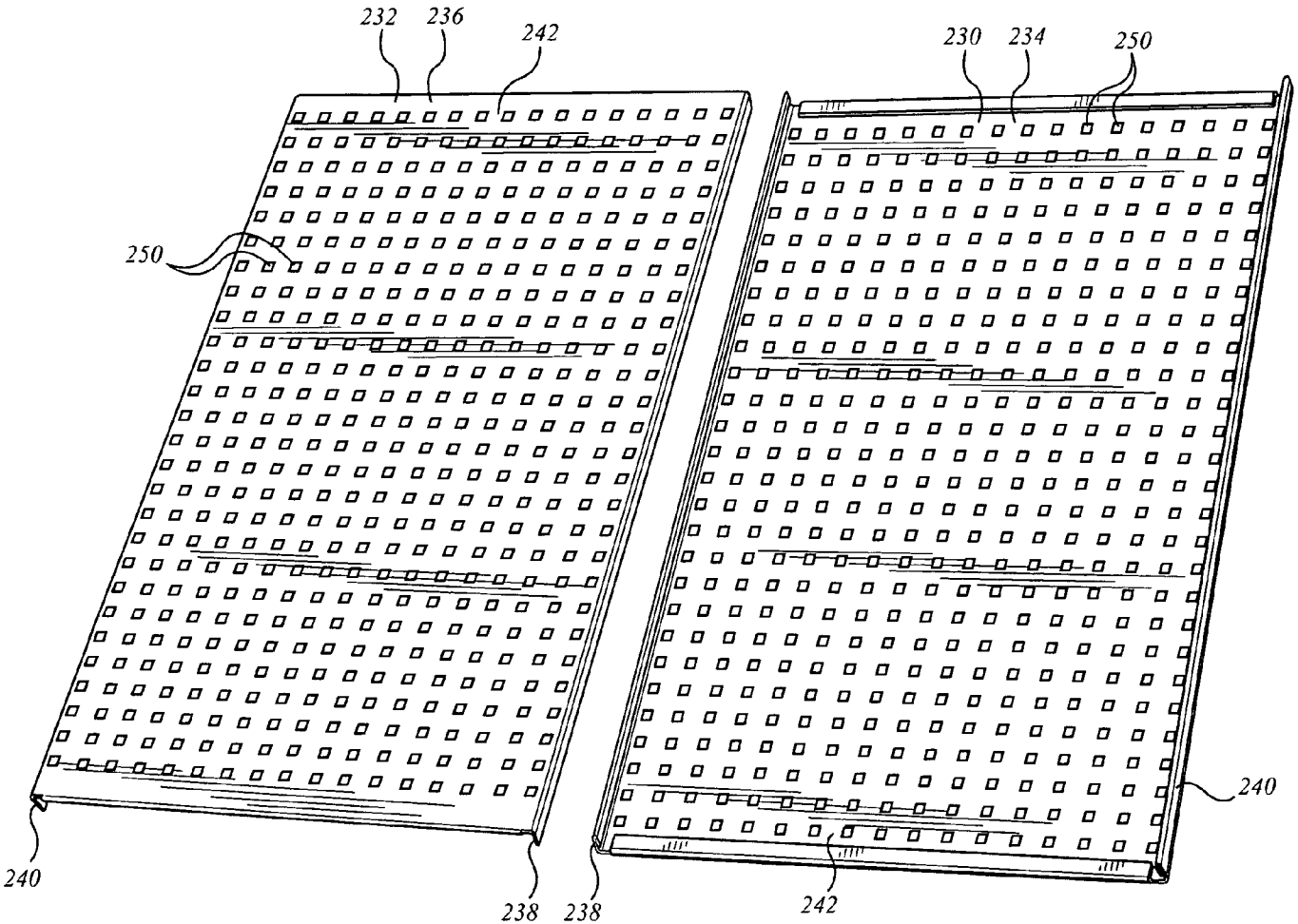
FIG. 13 shows internal deck panels of the apparatus of FIG. 1.
Figure 14:
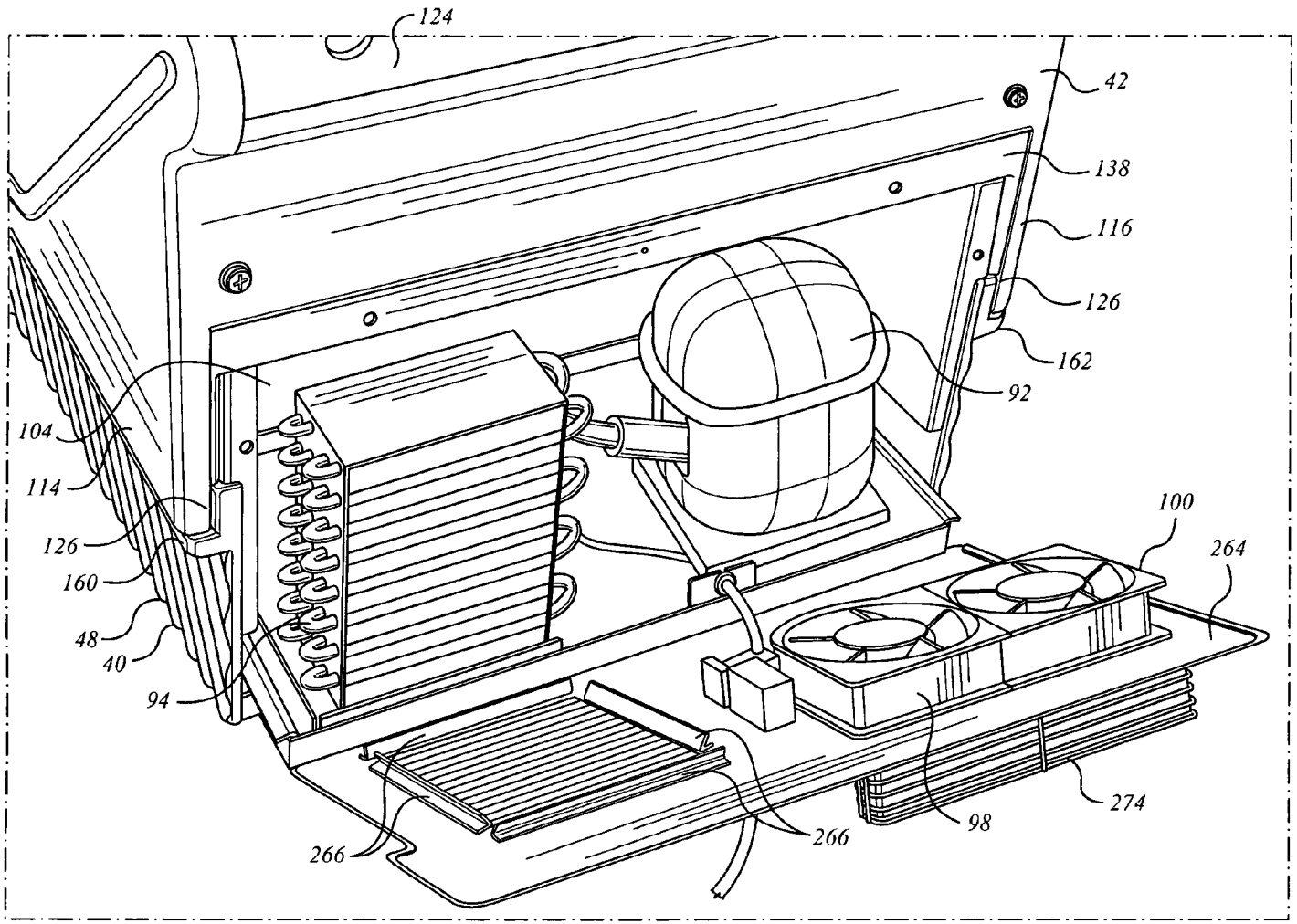
FIG. 14 shows rear view of the apparatus of FIG. 1 with closing panel released.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for the cooling apparatus 20 described herein, the height, in most common use, is measured vertically, and may be measured either from the base of the unit, or from a datum defined by the upper surface of a counter 18, such as a check-out counter in a grocery or convenience store, or fast food outlet. The width of the unit is a dimension measured generally horizontally across the unit as a person facing the unit might see it. The depth of the unit, or portion thereof, may be the front-to-back distance through the unit. The term "depth" is used in several contexts in this disclosure. In the context of a display bed, the depth may be the normal distance from the base of the display array or bed which, itself, may be angled relative to the horizontal. In the context of a flow plenum, the depth may be the through thickness of the plenum, as contrasted with the length (distance along the plenum) or width or breadth (across the plenum, cross-wise to the flow direction).

By way of general overview, a cooling apparatus according to an aspect of the present invention is shown in the various Figures as 20. At a global level, apparatus 20 includes a housing, such as may be termed a housing structure or assembly, 22, to which a bed plate 24 is mounted to define a heat exchange plenum 26 (below bed plate 24), and a bed for objects to be cooled, indicated generally as 28, and in which a lodgement 30 is defined for various elements of a heat extraction system, such as a vapour cycle cooling system 32. In operation, cooled goods such as beverages or sandwiches are placed in bed 28. Cooling system 32 is operated to cool air in plenum 26 running under bed 28, and to urge that air out through an outlet, or outlet manifold 34 to drift down over the objects to be cooled in the bed. At the lower end of bed 28 there is an air intake 36 for plenum 26. Inasmuch as bed 28 may have a shape generally resembling a box that has been tilted on an incline, there may tend to be a pooling region 38 next to air intake 36 such that the cooler air may tend to be re-circulated back into the plenum.

Looking at cooling apparatus 20 in greater detail, the framework structure of the self-contained cooling apparatus 20 is the housing, or housing assembly 22. Housing assembly 22 may have a two piece moulded construction that may include a first moulded part 40 and a second moulded part 42, bonded or fastened together after moulding. The two moulded parts, 40, 42 may have continuous double walls filled with a foam insulation. Housing assembly 22 may be made of a moulded plastic such as Polyethylene which may be rotationally moulded. The first moulded part 40, such as may be referred to as the base, may include a front wall portion 44, a generally upwardly and rearwardly extending wall 46 which may be of irregular form, and left and right hand side wall portions 48 and 50.

Front wall portion 44 may have a first, or main portion 52 that is generally rectangular, and that slopes generally upwardly and forwardly of the meeting with wall 46. The outwardly facing surface of portion 44 may have a decorative pattern formed therein, such as corrugations, or flutes 54. At the upward end, front wall portion 44 may terminate in a bulbous portion 56 that may have a generally upwardly facing stepped sill 58 for interlocking mating engagement with second molded part 42. The inner facing portion of front wall portion 44 may have a standoff member 60, or members, such as may be in the nature of lateral lands 62 and 64, such as may have the form of an abutment, or shoulder, standing proud of the main inwardly facing surface 66, and which may be referred to as plenum intake manifold abutments.

Wall portion 46 may have a first, downwardly facing region 68 that in use may sit in a substantially horizontal orientation, and, in some instances, may provide a base surface 70 upon which the unit (i.e. apparatus 20 generally) may sit. Wall portion 46 may also have a generally upwardly facing surface 72 that may be sloped, and that may run into surface on a smoothly radiused corner. Surface 72 may have a first, or lower, portion 74, a second, or upper portion 76, with a convergent transition portion 78 between portions 74 and 76. Wall portion 44 may also have formed in it, possibly centrally, a relief or port 80 by which an evaporator return line may be installed. Bed plate standoff members, such as may be in the nature of ledges, or shoulders identified as lateral abutments 82 and 84 stand proud of surface 72, and may provide side rails or seats on which to support laterally extending bed plate 24.

Inclined wall portion 46 may also include a downwardly opening relief portion 86 such as may tend to define the inner and upper walls 88, 30 of a lodgement, indicated generally as 30, for accommodating elements of the heat extraction apparatus such as a compressor 92, condensor 94, an expansion device, such as may be an adiabatic nozzle 96, and exhaust fans 98, 100. The upward and rearward edge 102 of inclined wall portion 46 may be formed to mate with a corresponding edge of portion of second molded part 42. The inner and upper surfaces of lodgement 30 may have a thermally conductive metal liner plate.

The side wall portions 48 and 50 may include a first portion 106 forming a generally triangular web between front wall portion 44 and inclined wall 46. First portion 106 may have a generally horizontal upper margin 108. Sidewall portions 48 and 50 may also include rearward side wall portions 110, 112 that bound lodgement 30 laterally. That region of side wall portion 110, 112 lying above the height of upper margin 108 may be outwardly relieved to accommodate the mating, downwardly extending sidewall, or skirt, portions 114, 116 of second molded part 42.

Second molded part 42 may include left and right hand sidewalls, 118, 120, a front framing member 122, and a rear cowling 124. Each of side walls 118, 120 has a notched region 126 for accommodating a clear plastic side shield 128, whose upper margin may be roughly tangent to front framing member 122 and rear cowling 124. Front framing member 122 has a stepped lower surface 130 for mating engagement with the stepped (or keyed, or indexed) upper sill 58 of the bulbous portion 56 of front wall portion 44; and a may have a radiused upper surface generally matching the radius of bulbous portion 56. Sidewalls 118 and 120 are molded to fit outside then wing or skirt portions 114, 116 of the sidewalls of lower molded part 40, such that the externally visible separation line 132 runs horizontally from the front to the back of the unit.

Rear cowling 124 may include a substantially vertically extending rear wall portion 134, and a substantially horizontal top wall portion 136, the two meeting at a smoothly radiused corner, and extending laterally from side-to side between side walls 118, 120. Rear wall portion 134 also has a depending lip 138. The lower edge of vertical wall portion 134 may be angled inwardly of lip 138 to form a mating notch to seat on with the chamfered nose of the upper edge of inclined wall portion 46 of first molded part 40. The overlapping interface of molded parts 40 and 42 at back and front, and in large portion along the sides, may tend to yield an assembly that is easily fit together, particularly if the upper molded part 42 is molded for a slight interference fit. It may be noted that the side portions of second molded part 42 may include upper wing extensions 140 having a slot 142 formed therein to receive a roll bar 144 of a removable cover 146. Cover 146 may be extended to cover bed 28, at times, for example when the store is closed, cover 146 then discouraging the spilling of cooling air from bed 28. The bottom edge 148 of cover 146 may have a cross bar 150 whose ends extend to seat in notches 152 in the upper margin of the clear plastic side shields 128.

The two plastic moulded parts 40, 42 may tend to provide an assembly that may be quickly joined together, with a small number of fasteners and without undue effort. The moulded hard foam plastic may tend to yield an insulated layer (namely the sloped sheet region) between the cooling air plenum, and the lodgement or chamber for the vapour cycle system such as the compressor and condenser, that may reject a significant amount of heat. Lodgement 30 may itself tend to form a hot air heat rejection plenum.

As assembled, it may be noted that the sidewall portions 48, 50 of lower molded part 40, have laterally extending flanges 160, 162, that may underlie the downwardly depending lower margins of the skirts 114, 116 of upper molded part 42. The underside of flanges 160, 162 may form downwardly facing peripheral supports, or mounting fittings, or seats, 164, 166, through which interfaces the weight of the unit may be carried into surrounding structure, as in the case where unit 20 is mounted to sit in a partially sunken manner in an aperture or accommodation made in a store counter. It may also be that the juncture of the radiused bulbous portion 56 of front wall portion 44 may be roughly flush with seats 164, 166, thereby providing a third edge along which underlying structure may support the loaded unit. This may yield a three-sided, generally U-shaped mounting fitting support interface.

It may be noted that many possible configurations of mounting fitting may be constructed. In the embodiment illustrated, the footprint of the base is smaller than the footprint of the shoulder, such that at least a portion of the footprint of the shoulder extends beyond the footprint of the base, with the result that while the footprint of the base may be lowered through an opening made therefore in a counted, those portions of the footprint of the mounting fitting that protrude beyond the footprint of the base may tend to seat upon, or mate with, the land about the opening formed to admit the base. Although additional fittings, such as brackets, may be mounted to the housing for this purpose, provision of the shoulder in the molded form of the housing itself may tend to eliminate the need for additional separate parts to be made and attached.

The mounting fitting support interface may be located to permit apparatus 20 to be mounted either on the planar base, generally, or for a substantial portion of apparatus 20 to be mounted in a sunken, or recessed, manner, which may be less obtrusive, and which may require less above counterspace. Taking the height of the base of the unit as $h_1$ as measured from the substantially planar, horizontal bottom surface to the substantially parallel planar underside of the mounting fitting, and taking the height of the superior portion of the unit as $h_2$, with the total oval height of the unit, $h_{total}$ being the sum of $h_1$ and $h_2$. In one embodiment, the ratio of $h_1$ to $h_2$ may be in the range of 1:4 to 1:2, and may be about 2:5.

The lower portion 168, 170 of the outwardly facing surfaces of side wall 118, 120, lying below flanges 164, 166 may have a decorative wavy, or fluted, or corrugated pattern 172 formed in relief, and such pattern may be inclined at an angle. The angle may be roughly the same as the angle of inclination of front wall portion 44 more generally.

Once the upper and lower parts 40, 42 of the moulded housing assembly 22 have been fit together and secured, either by mechanical fasteners such as threaded fasteners or by bonding, the remaining fittings may be installed.

A heat exchanger 174 may be mounted to lower portion 74 of surface 72. Heat exchanger 174 may extend the full width between shoulder abutments 62 and 64, and may have a through thickness depth that is, within tolerance, substantially the same as the height of the shoulder abutments 62, 64 such that the upper surface of the heat exchanger is roughly flush with the upper surface of the shoulders. The upper-surface of the heat exchanger may have a seal member 176, such as may be an elastomer, to take up any mismatch in height, and to discourage air flow past the heat exchanger, rather than through it. When overlying plate 24 of the cooler bed 28 is in place, heat exchanger 174 may tend to lie across the entire flow path of the resulting plenum, such that air forced along plenum 26 may tend to be compelled to flow through heat exchanger 174 rather than around it. The upslope bottom corner of heat exchanger 174 may seat in a relatively sharp corner formed at the juncture of transition portion 78 with lower portion 74 of surface 72.

Upstream of heat exchanger 174 is a baffle plate 178 that also extends across, and blocks, the flow path of air plenum 26. Baffle plate 178 has two openings 180, 182 formed therein, and location fittings 184, in the nature of appropriate fastener hole patterns, to which a pair of air moving devices 186, such as may be blowers or fans 188, 190 may be mounted. It may be understood that a single fan could be used, or more than two fans could be used, and that the illustration of two such fans is intended to be representative of any number of such units. It may be that two such units, mounted to work in parallel, may be employed.

Figure 15A:
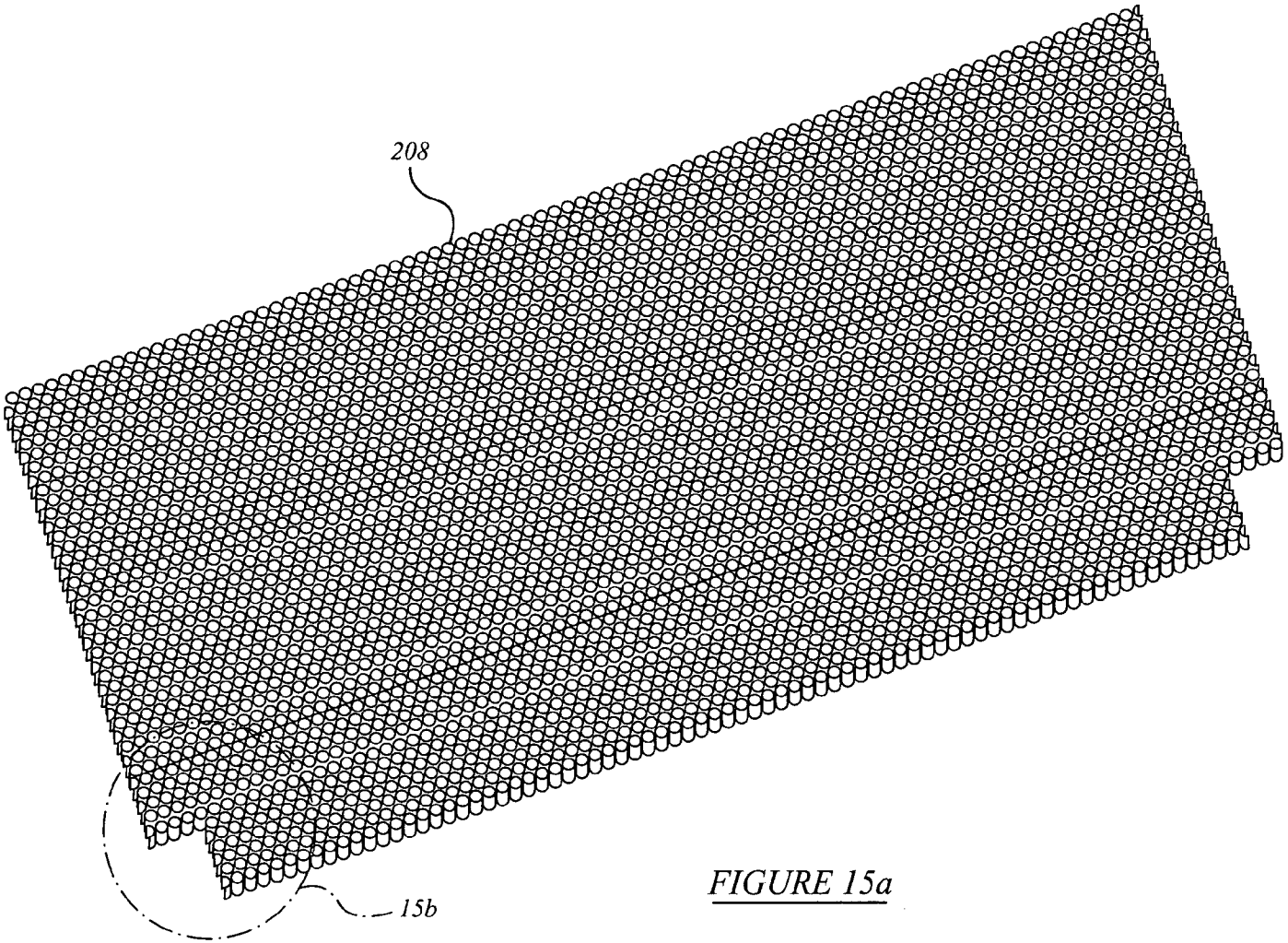
FIG. 15*a* shows a manifold panel of the apparatus of FIG. 1.
Figure 15B:
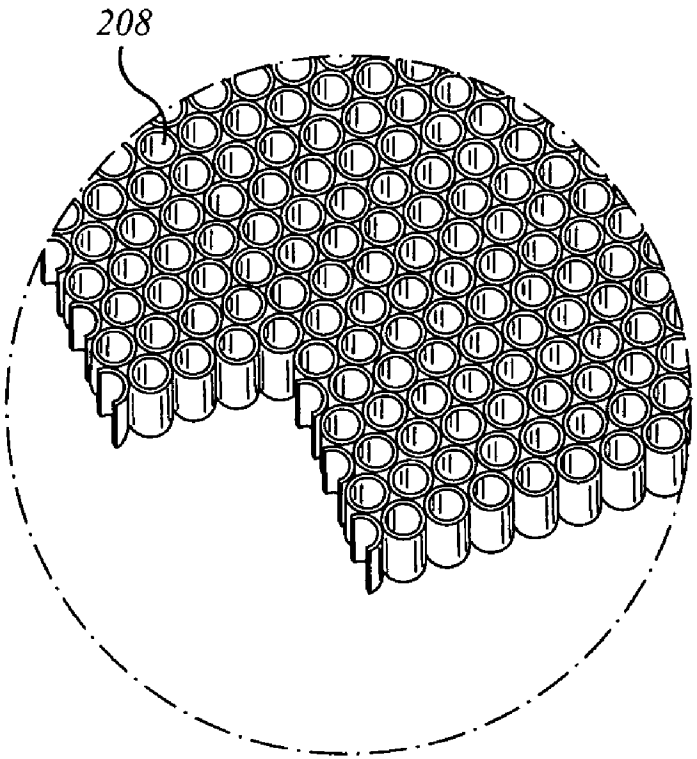
FIG. 15*b* shows an enlarged detail of the manifold panel of FIG. 15*a*.

A thermally conductive sheet or plate member, such as plate 24 may seat over shoulders, thus closing, the hollow rectangular passageway to define air cooling plenum 26. It may be noted that plate member 24 has a first portion 192 for seating on the shoulders namely abutments 82, 84 which portion may be planar; and a second, lower or foot portion 194, that may be bent at a right angle, and that may seat on the shoulders defined by lateral lands 82, 84 of front portion 44 of housing assembly 22. Foot portion 194 may have intake porting, such as may be in the nature of an array of vents or apertures or slots, indicated generically as 196. The placement of plate 24 in this position may tend to enclose internal air cooling plenum 26. Plenum 26 may then have an inlet, indicated generally as air intake 36 at array 196, and an outlet indicated generally as 200 at the upper, laterally offset end of the enclosure. An outlet array 202 may be mounted across outlet 200 between a retaining guide, or channel 204 mounted in the roof portion, and an angle retainer 206 installed along the lower edge of array 202 and secured at either end to shoulders 82, 84. Outlet array 202 may be in the nature of a flow resistance element 208 that may be porous. In one embodiment array 202 may include a large number of tubes, or a honeycomb, or honeycomb-like structure (See enlarged detail of FIG. 15*b*) that may tend to yield a measure of flow resistance, and that may tend also to cause the flow leaving the plenum to have a relatively flat velocity profile. That is, the velocity of cooled air leaving the plenum may tend to be generally uniform across the outlet array, or more uniform than it might otherwise be.

The resulting plenum structure may be thought of as having several regions. There is an inlet manifold region, indicated generally as 210, that may lie between sidewalls 48, 50, the inclined front wall portion 44, and foot portion 194; a high pressure region 212 located between the air movers 186 and heat exchanger 174, a convergent region 214 immediately downstream of heat exchanger 174; a generally rectangular, relatively high aspect ratio region 216 downstream of the convergent section, and an outlet manifold region 218 where the narrowed rectangular region 216 deepens (and in which the flow may tend to decelerate and be impeded by the outlet manifold flow resistance element 208 of an outlet manifold region 218. As may be appreciated, in operation, the inflow at foot portion 194 may tend to be diffuse. Operation of air movers 186, may tend to create a low pressure in intake manifold region 210 as compared to external ambient (indicated as $P_\infty$) outside the cooling apparatus. This difference in static pressure may tend to cause air to enter, in a relatively even manner through the intake manifold array 196 into the intake manifold region 210. Air movers 186 may draw in that air, and may urge it, at a raised static pressure, into pressurized region 212. The resistance of heat exchanger 174 may tend to have at least a modest flow-evening effect. The mean flow velocity through the heat exchanger may not be excessive, given the large cross-sectional area of the heat exchanger element (the full width of the plenum $W_P$, at a depth $\delta_1$ as great as the size of the fan housings). Downstream of heat exchanger 174, the flow velocity may tend to increase as the plenum section decreases. In one embodiment, the depth of the air flow passage may be reduced by half, and may be reduced by as much as 60% (+/−). The length, $L_2$ of the narrowed portion may be more than five times the through-thickness depth $\delta_2$, which may also tend to encourage the flow to settle into a sheet-like profile that is relatively even across the width of the unit. In width, the width of the plenum, $W_P$, which is substantially constant between the inlet manifold and the outlet manifold, extends across more than half the width of the unit, and may, other than for the width of the shoulders, extend across substantially the entire width of housing assembly 22. In the narrowed, or shallowed, region of the plenum, in one embodiment the Nusselt number based on hydraulic diameter, $Nu_d$ may nominally be in the range of 10 to 25, and may be about 14, without adjustment for non-fully developed flow. In one embodiment, the flow Reynolds number based on hydraulic diameter may be in the range of 3000 to 10 0000. Similarly, in one embodiment the nominal convection heat transfer coefficient, $h_d$, 3 to 15 W/mK, and may be about 5½ to 6 W/mK. In one embodiment, the aspect ratio of width, $W_P$, to depth, $\delta_2$, of the plenum in the narrowed region 216 may be 8 or greater. In another embodiment, it may be 12 or greater, and in another embodiment it may be about 15 where the depth of the narrowed section may be about 1¼ inches, and the width may be about 19 inches. This may tend to yield a duct having an hydraulic diameter greater than 160% of the through thickness of the passage, with a consequent relatively higher convective heat transfer co-efficient on the underside of the overlying inclined portion 192 of the bed plate 24. Like the relatively high flow resistance of the heat exchanger, the high aspect ratio of the duct may tend to cause the velocity profile of the flow in the duct to be relatively flat from side to side across the duct. As the flow leaves shallow, or narrowed region 216, the section of the plenum widens (or deepens, actually, while the width remains constant), which may tend to encourage the flow to decelerate. The momentum of the flow, as it may be, may tend to encourage the flow to attach (i.e., work preferentially along) the curved rear wall 220. A flow interrupter 222, such as may be in the nature of an angle 224, may be mounted to the rear wall 220 of the outlet manifold region 218. Flow interrupter 222 may tend to force the flow outward from wall 220 into the main body of outlet manifold region 216. The flow resistance in the outlet manifold, like the resistance of the heat exchanger and the high aspect ratio of the duct, may tend to urge the velocity profile of the exiting flow field to be generally uniform. It may also be noted that the outlet array 202 has roughly the same width as the flow plenum 26, more generally, but a depth of roughly four to six times the depth of narrow portion of the flow plenum. It may be that the outlet flow field may have a mean flow velocity of the order of 6–18 inches/second. Considering the bed to be a three sided open channel, the overall Reynolds number based on hydraulic diameter may be of the order of 2,500 to 10,000, and may in one embodiment be about 5000.

Bed 28 may have additional panel member 230, 232, such as may be in the nature of formed channels 234, 236. Channels 234, 236 may have legs 238, 240 and a web 242. Panel members 230 and 232 may be mounted with their toes facing downward, such that legs 238, 240 may function as stand-off members to hold webs 242 in spaced relationship away from upper portion 192 of the bed plate 24. This may tend to yield a drain plenum, or plenums 246, 248. The webs 242 of panel members 230 and 232 may have porting in the nature of an array of apertures 250. The length of panel members 230 and 232 may be slightly shorter in length that the space between foot panel 134 and retainer angle 206. Moreover the radius between portion 194 and 192 may tend to prevent the open bottom end of channel members 234, 236 from being tightly closed. As may be noted, bed plate 24 may be made of a thermally conductive material, such as may be aluminum or stainless steel, and may tend to be cooled by the output of heat exchanger 174. Consequently, air tending to drain between channels 234, 236 and plate 24 may tend also to be cooled. Further, that air, being relatively cooler and denser than other air, may tend to have a negative buoyancy, and may tend to drain downward toward foot panel 194. Further still, as that cooled air drains away, it may tend to draw in replacement air, and, as such, may tend to urge the air immediately above to be drawn toward the base plate through apertures 254, rather then to be forced out into the ambient surroundings. Channels 234, 236 may be considered to be air drain manifolds. It may also be noted that apertures 250 may be of a shape, such as square, and a size, to co-operate with the locating feet of zone dividers, 244, such as may be used in either cross-wise or length-wise orientations to divide rows of bottles, or to space sandwiches or fruits to keep them from impinging on adjacent items.

As may be noted, bed 28 may have something of the shape of a tilted open front box, in which the desired flow direction is between the outlet manifold 218 of cooling plenum 26 and the inlet manifold 210 of cooling manifold 26, The maintenance of a relatively stable, predominantly uni-directional flow field between outlet manifold 218 and the inlet manifold 210 may tend to be enhanced by a number of factors.

First, the proportions and overall size of the apparatus may tend to discourage flow perturbations, and to encourage the flow to remain within a relatively small envelope. The sides of the open flow channel of bed 28 may include superior portions that may include see-through baffles or partitions, such as side shields 128, such as may be mounted in the upper margins of the side walls of upper moulded part 42. These baffles, and the sidewalls generally, may tend to channel the flow to run linearly between the outlet manifold and the inlet manifold of plenum 26. They may also tend to discourage external perturbations from interfering with the desired cooling flow. In addition, the overall depth of the sidewall, indicated as $h_3$, may be greater than the depth of the outlet manifold, indicated as $h_4$. The ratio of $h_3$ to $h_4$ may lie in the range of 6:5 to 5:3, and may be about 9:7 to 4:3. Further, the overall width of the open flow channel is not excessive as compared to its length. That is, the mean length of the flow path from the center of the outlet manifold of plenum 26 to the center of the inlet manifold of plenum 26 is indicated as $L_1$. The width is indicated as W. The ratio of depth $h_3$ to width W may be more than ¼., may be in the range of 1:2 to 1:2, and may be about 2:5. The ratio of the width W to length L may be less than 3:2, may lie in the range of 4:3 to 4:5, and may be about ⅚ to ⅞, (+/−10%). The length of the flow path between the outlet manifold and the inlet manifold may also be relatively short as compared to the depth. The ratio of $h_3$ to L may be greater than ¼, may lie in the range of than 3/10 to ½, and may, in one embodiment be between ⅓ and ⅜. In one embodiment, W may be about 22 inches, L may be 18½ to 19 inches, $h_1$ may be about 6½ inches, $h_2$ may be about 15½ inches, $h_3$ may be about 6½ to 7 inches and $h_4$ may be about 8½ to 9 inches, all dimensions being +/−10%. The unit may fall within an overall envelope that is less than 30 inches wide, less than 36 inches deep from back to front, and less than 30 inches tall. The volumetric envelope of the entire apparatus 20 may be less than 15,000 cu. in., and in one embodiment may be less than 11,000 cu. in., and of that, if a sunken installation is used, the exposed volume occupied may fit within an envelope that is less than 30 inches wide, less than 36 inches deep, and less than 24 inches high; and that envelope may have a volume of less than 11,000 cu. in, and in one embodiment, less than 8,500 cu. in. In one embodiment, the unit may weigh less than 80 lbs.

Second, the use in flow resistance element 208 of parallel capillaries or small diameter tubes, such as may have a length more than 5 times their diameter, may tend to straighten, and calm, the output of cooling plenum 26. Further, the resistance of those tubes may tend to cause the output across the array to be more even. Third, the lower end of the box may tend to form a pooling zone having a triangular bottom between parallel sidewalls in which the relatively cooler air, being less buoyant, may tend to collect. The upper lip of the pooling region may be the top of front framing member 122. Fourth, the use of an intake manifold array of porting or apertures, such as slots 212 in foot panel 64 may tend to permit the pooling zone to be drained, and may permit the draining to be distributed across the face of the pooling zone. Fifth, the low, or very low, Reynolds number may point to a flow that is substantially laminar if undisturbed, or that may have a tendency away from being strongly turbulent. Sixth, the use of a perforated return drain along the floor of the bed (namely channels 234, 236) may tend to draw the cooled air down, toward bed plate 24, rather than encouraging it to spill outside the box. These features are thought advantageously to increase the proportion of air returned to the intake manifold that may tend to be recirculated cooled air that has already been cooled below the more generally prevailing ambient temperature $T_\infty$, and may tend to improve the overall efficiency of the unit and tending to reduce the cooling load and so too the power required and the heat rejection to ambient.

In cooling apparatus 20, the cooling system may be a vapour cycle system 32, and heat exchanger 174 may be the evaporator of such a system. The other elements of such a system may include compressor 92 whose intake is from a low pressure return line 256 in fluid connection with the output fitting of heat exchanger 28. Low pressure return line 256 may by installed through molded port 258 made in inclined wall portion 46. Insulating putty or sealant may be used to further discourage heat loss or flow migration through port 208. Compressor 92 may be mounted on a base plate 260, itself mounted to lower part 40 of moulded housing 22. The compressed working fluid output from compressor 92 may be led through a high pressure gas line 262 to condensor 94. Condensor 94 may be mounted to a rear closure panel 264 that forms the closed back panel of the vapour cycle equipment lodgement 30. Condensor 94 may take the form of a heat exchanger mounted to seat against the peripheral seals 266 of a corresponding opening 268 in back panel 264. Air moving equipment, such as may be in the nature of a pair of rejected heat exhaust blowers, or fans, 98, 100 are mounted to another portion of panel 264, and, given the otherwise generally sealed nature of lodgement 30, conservation of mass requires that air drawn in through the heat exchanger fin array of condensor 94 must be purged through fans 98, 100, thus cooling compressor 92 as well. An exhaust shroud, or doghouse, or standoff housing 274 may be mounted about the outlet of fans 98, 100 to prevent the unit from being forced too tightly against a rear surface, such as might otherwise prevent fans 98, 100 from providing the airflow desired to cool the unit. A cooled high pressure line 274 leads from condenser 94 to a substantially adiabatic expansion device, such as may be in the nature of a nozzle 276. The cooled, low pressure output of this element is fed through a coolant feed line 278 through insulated inclined panel portion 46 to the downstream side of heat exchanger 174, bringing the cycle back to its starting point. The unit may be controlled by conventional thermostatic settings on the rear of the unit.

An optional cover 280 may be employed when the unit is in a passive mode, such as when the store is closed, if the unit is used in a store. The unit is provided with a thermometer 282. To reduce the height profile of the unit, much of the base can be sunk into a counter top, such that the unit is supported about its periphery on the shoulder 284, the front portion of the shoulder being defined by the underside of the bulbous portion of the front of the unit.

Thus, the apparatus described is a mechanically cooled, insulated container that may be used to permit manual dispensing of bottled or canned goods, sandwiches and other fast food items. The container is so configured that a cold air curtain, which tends to isolate the merchandise from the outside temperature, drops at a relatively acute angle such as may tend to allow the merchandise to be displayed in an advantageous, highly visible, and conveniently reachable angle.

Various embodiments of the invention have been described in detail. Since changes in and or additions to the above-described best mode may be made without departing from the nature, spirit or scope of the invention, the invention is not to be limited to those details but only by the appended claims.

We claim:

1. A cooling apparatus comprising:

a plenum having an inlet and an outlet, the outlet being located higher than the inlet and being offset in a lateral direction therefrom;

a heat exchanger mounted in said plenum between said inlet and said outlet;

at least one air moving device mounted in said plenum in series with said heat exchanger, said air moving device being operable to draw air in at said inlet, and to compel air to pass through said heat exchanger and to exit said plenum at said outlet;

an open faced bed mounted between said outlet of said plenum and said inlet of said plenum;

said bed having a pooling zone to which relatively cooler air may drain, said inlet of said plenum being mounted to draw from said pooling zone; and said bed having an air drain manifold mounted therein, said drain manifold being located in said bed in a position to facilitate movement of air to said pooling zone.

2. The cooling apparatus of claim 1 wherein said cooling apparatus is a self contained cooling apparatus further including a housing, said open bed being defined within said housing;

said housing having an upper portion and a lower portion, and at least one intermediate mounting fitting, said upper portion standing upwardly of said mounting fitting, and said lower portion extending downwardly of said mounting fitting.

3. The cooling apparatus of claim 2 wherein said mounting fitting is a peripheral mounting array.

4. The cooling apparatus of claim 3 wherein said peripheral mounting array includes at least one shoulder.

5. The cooling apparatus of claim 2 wherein said upper portion has a first peripheral footprint, said lower portion has a second peripheral footprint, at least a portion of said first peripheral footprint extending proud of said first peripheral footprint, and said mounting fitting including at least one shoulder between said upper and lower portions of said housing.

6. The cooling apparatus of claim 1 wherein:

said cooling apparatus is a self-contained cooling apparatus further including a housing, said open bed being defined within said housing, and said plenum being contained within said housing;

a vapour cycle cooling system is mounted within said housing, said heat exchanger being an evaporator of said vapour cycle cooling system; and said cooling apparatus is contained in a volumetric envelope of less than 15,000 cubic inches.

7. The cooling apparatus of claim 1 wherein said cooling apparatus is a self-contained cooling apparatus having an upper portion, a lower portion, and a mounting fitting, said mounting fitting being placed between said upper portion and said lower portion, said upper portion having a first height, said lower portion having a second height, and a ratio of said first height to said second height being in the range of 1:5 to 1:3.

8. The cooling apparatus of claim 1 wherein said apparatus has a width and said plenum extends across at least half of said width.

9. The cooling apparatus of claim 8 wherein said plenum extends across more than 80% of said width.

10. The cooling apparatus of claim 1 wherein a portion of said plenum downstream of said heat exchanger has a width, W, and a depth, D, and an aspect ratio of said width to said depth of greater than 8:1.

11. The cooling apparatus of claim 10 wherein said aspect ratio is greater than 12:1.

12. The cooling apparatus of claim 1 wherein said plenum has a narrowed region downstream of said heat exchanger, and a wider, deceleration region downstream of said narrowed region adjacent said outlet.

13. The cooling apparatus of claim 1 further comprising a resistance array mounted athwart said outlet.

14. The cooling apparatus of claim 1 wherein said bed has a base wall, said base wall of said bed also forming a wall of said plenum downstream of said heat exchanger.

15. The cooling apparatus of claim 1 wherein said open bed has raised sidewalls extending between said outlet of said plenum and said inlet of said plenum.

16. The cooling apparatus of claim 15 wherein said bed included an inclined base wall.

17. The cooling apparatus of claim 1 and further including a removable cover for enclosing said open bed.

18. The cooling apparatus of claim 1 and further comprising a molded plastic housing, said housing bounding said bed, and defining a lodgement for a vapour cycle cooling system, said heat exchanger being an evaporator of said vapour cycle cooling system, said moulded plastic housing including an insulated wall between said lodgement and said plenum.

19. The cooling apparatus of claim 1 having a weight of less than 80 lbs., and falling within an envelope less than 30 inches wide, 30 inches high, and 36 inches deep.

20. The cooling apparatus of claim 1 wherein 1 said apparatus causes a cooling flow to pass through said bed, and said cooling flow has a nominal Reynolds number in the range of 2500 to 10,000.

21. The cooling apparatus of claim 1 wherein said plenum and said bed are separated by a bed plate, said bed plate forming a wall of said plenum, and, in operation, downstream of said heat exchanger, said bed plate flow interacting with said bed plate within said plenum has a nominal Nusselt number in the range of 10 to 25.

* * * * *